United States Patent [19]

Sansotta et al.

[11] Patent Number: 4,711,319

[45] Date of Patent: Dec. 8, 1987

[54] SAW HORSE

[76] Inventors: Carmelo Sansotta, 10 Starr Rd., East Brunswick, N.J. 08816; George Spector, 233 Broadway RM 3815, New York, N.Y. 10007

[21] Appl. No.: 943,631

[22] Filed: Dec. 19, 1986

[51] Int. Cl.[4] ..... B27B 21/00

[52] U.S. Cl. ..... 182/155; 182/181; 182/225

[58] Field of Search ..... 182/155, 181–186, 182/224, 225, 226, 153

[56] References Cited

U.S. PATENT DOCUMENTS

| | | | |
|---|---|---|---|
| 862,725 | 8/1907 | Fietsam | 182/155 |
| 2,473,342 | 6/1949 | Larson | 182/155 |
| 2,755,144 | 7/1956 | Simmons | 182/155 |
| 2,897,911 | 8/1959 | Bowers | 182/155 |
| 3,016,104 | 1/1962 | Johnson | 182/155 |
| 4,489,808 | 12/1984 | Voye | 182/155 |

*Primary Examiner*—Reinaldo P. Machado

[57] ABSTRACT

A sawhorse that is foldable and adaptable to stand up without wabble on any uneven surface; the sawhorse including two hollow backbone sections pivoted together at one ends thereof so to form a long backbone assembly, and a pair of pivotable legs attached to each section so to pivot outwardly of the hollow interior of the sections so to stand upon a ground or other surface.

3 Claims, 5 Drawing Figures

Fig. 1
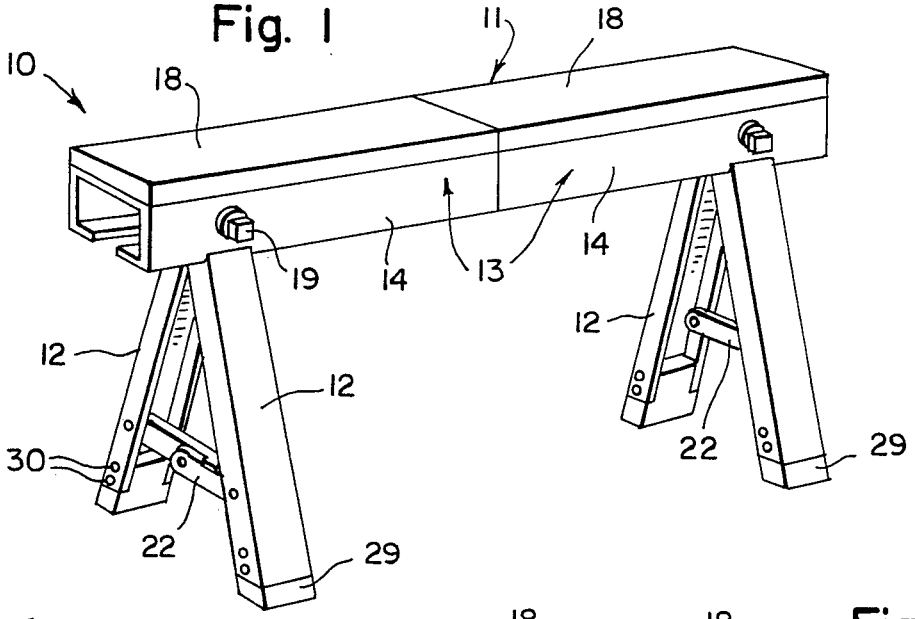
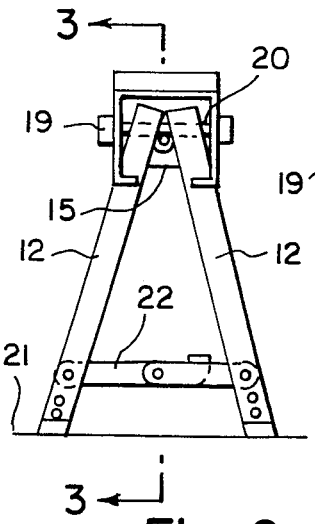
Fig. 2
Fig. 3
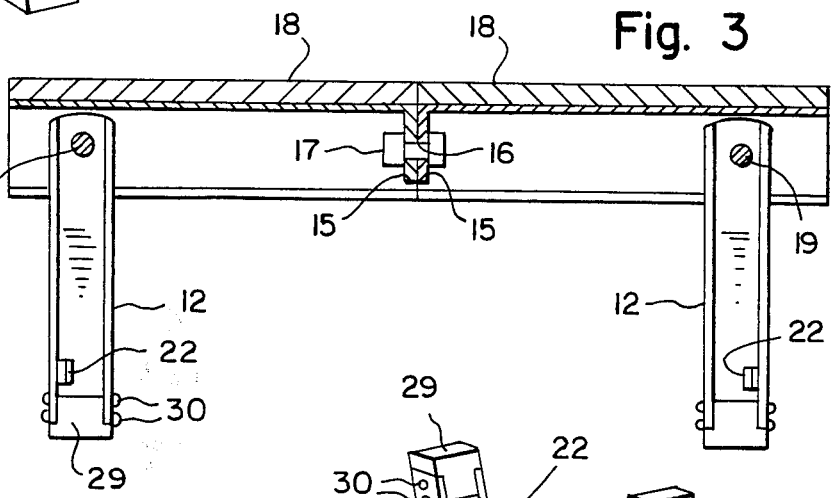
Fig. 4
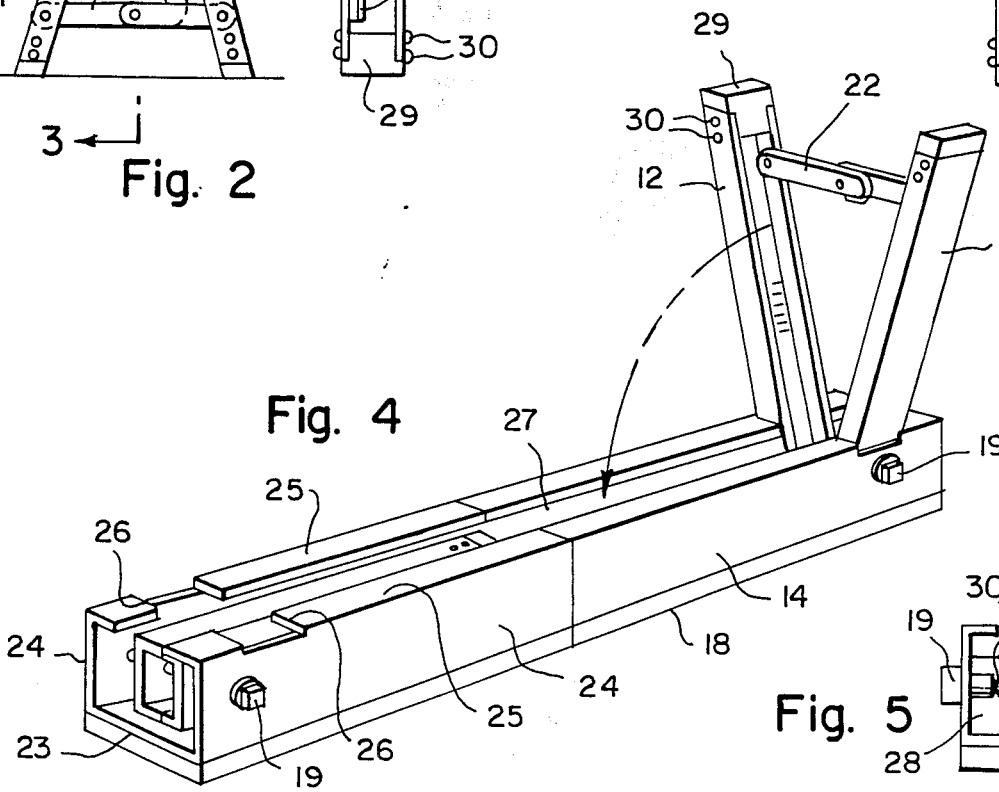
Fig. 5
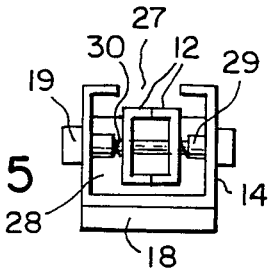

SAW HORSE

This invention relates generally to sawhorses such as are used for wood being laid thereupon for sawing.

It is well known that sawhorses are conventionally made to be rigid by including a horizontal backbone firmly affixed upon four downwardly diverging legs. Such sawhorses take up a lot of space when being transported on a vehicle such as by a carpenter or other construction worker to a job.

Therefore it is a principle object of the present invention, to provide a sawhorse that is readily collapsible so that it may be folded up to take a minimum space when being transported on a vehicle, and be easier to handle in its collapsed condition, but which when opened up, is equally strong as a conventional, non-foldable sawhorse.

Another object is to provide a foldable sawhorse which additionally includes the feature of three point supports so that the sawhorse will not wobble such as a conventional rigid, four-legged sawhorse, when stood upon on uneven ground.

BRIEF DESCRIPTION OF THE DRAWING

FIG. 1 is a perspective view of the collapsible sawhorse in erected condition;

FIG. 2 is an end elevational view of the sawhorse of FIG. 1 in erected condition;

FIG. 3 is a side elevational view of the sawhorse of FIG. 1 in erected condition;

FIG. 4 is a perspective view of the sawhorse in a semi-collapsed position; and FIG. 5 is an end view of the collapsed sawhorse.

Referring now to the drawing in greater detail, the reference, numeral 10, represents a sawhorse, according to the present invention, wherein there is a backbone assembly 11 mounted upon four legs 12. The backbone assembly is comprised of two backbone sections 13, each of which is made from an elongated metal channel 14 which at one end includes a flat metal plate rigidly welded thereto so to form an end wall 15 integral therewith. The backbone sections are placed adjacent each other, end to end, with the end walls 15 of both sections against each other. Each wall 15 has an opening 16 therethrough, the openings aligned with each other, so that a strong single rivet 17 through the two openings secures the sections together; each section being freely pivotable about the rivet.

A wooden face plate 18 is affixed upon a top of each section, either by means of rivets (not shown) or by other means, so as to form a surface that will not injure saw teeth or other sharp tools that may contact the sawhorse.

Each of the backbone sections has a pair of legs 12 pivotally attached thereto by means of a single transverse rivet 19 through an outer end portion of the channel; the rivet extending through oversized pair of holes 20 in an upper portion of the two, side by side legs; the holes 20 being oversized so to allow the legs to be tilted away from each other, as shown in FIG. 2, in order that the lower ends of the two legs may be spread apart for standing upon a ground 21.

A foldable brace 22 between the two legs serves to retain the legs in the downwardly spread apart position.

As shown in the drawing, the channel 14 includes an elongated central wall 23, a side wall 24 along each side edge thereof, and a flange 25 along the outer edge of each side wall 24. The channel is cross sectionally rectangular. Each flange includes a notch 26 in which the leg fits when in the spread apart, standing position; the notches serving to prevent the legs from pivoting around the rivet 19 and folding up from their standing position.

However, when the sawhorse is intended to be collapsed, then the brace is folded up, so that both legs may be swung toward each other so as to be adjacent alongside one another, and thus be pivoted through the gap 27 between the flanges and inside the storage space 28 inside the channel, as clearly shown in FIG. 5. A tube 29 is provided between each leg 12 and channel 14 to retain springs 30 against legs 12 for stabilizing and centering purposes.

It is to be noted that each section 13 is accordingly supported at three points when the sawhorse is in an erected position; the three points comprising the two legs and the rivet 17, so that the sawhorse will thus stand rigidly, without wobbling, upon any flat or uneven ground, by means of its two groups of three-point supports.

What is claimed as new, is:

1. A sawhorse, comprising in combination, a backbone assembly and a plurality of four legs for supporting said backbone assembly elevated above ground or other supporting surface, means for said legs being longitudinally pivotable between a downward operative position and a stored away position inside said backbone assembly, and means for said sawhorse to stand up without wobbling upon any uneven said ground or other supporting surface, wherein the first said means includes each pair of said legs being longitudinally pivotable on a transverse shaft near each opposite end of said assembly, a brace between said legs so to spread a lower end thereof when in said operative position, in combination with means for also pivoting said pair of legs transversely, wherein said means to prevent wobbling comprises said assembly being made of two channels with ends pivotally secured together at one end thereof so to form two groups of three point supports for said sawhorse, further including resilient means for biasing said pairs of legs towards each other thereby centering and stabilizing said legs in said operative position.

2. A sawhorse comprising a backbone with pairs of legs at each end of said backbone, wherein said backbone comprises aligned longitudinal sections pivotally connected at an inner point permitting relative torsional movement of said sections thereby providing three point support for each section.

3. A sawhorse as in claim 2, wherein each said pair of legs is longitudinally pivotable about a transverse shaft and includes further means for transverse pivotal movement relative said sections, in combination with means on said sections for restraining said legs from longitudinal pivoting when said legs are pivoted transversely away from each other.

* * * * *